US006824207B1

(12) United States Patent
Lin

(10) Patent No.: US 6,824,207 B1
(45) Date of Patent: Nov. 30, 2004

(54) CHAIR ASSEMBLY

(76) Inventor: Chen-Hsiung Lin, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/689,928

(22) Filed: Oct. 17, 2003

(51) Int. Cl.[7] ..... A47C 4/00
(52) U.S. Cl. ..... 297/16.1; 297/16.2; 297/46
(58) Field of Search ..... 297/16.1, 16.2, 297/46; 108/118, 119, 120

(56) References Cited

U.S. PATENT DOCUMENTS 780,007 A * 1/1905 Mettler ..... 297/46
4,577,901 A * 3/1986 Phillips ..... 297/17
4,967,672 A * 11/1990 Leather ..... 108/120
5,454,575 A * 10/1995 Del Buono ..... 280/35
6,062,589 A * 5/2000 Cheng ..... 280/647
6,332,646 B1 * 12/2001 Tseng ..... 297/16.1

* cited by examiner

*Primary Examiner*—Peter M. Cuomo
*Assistant Examiner*—Joseph Edell

(57) ABSTRACT

A chair assembly includes a first support stand, a second support stand, a support frame, four support tubes, four connecting members, two first mounting members, two elastic members, and two second mounting members. Thus, the chair assembly can be folded and expanded easily and conveniently. In addition, the chair assembly can be supported rigidly and stably.

8 Claims, 4 Drawing Sheets

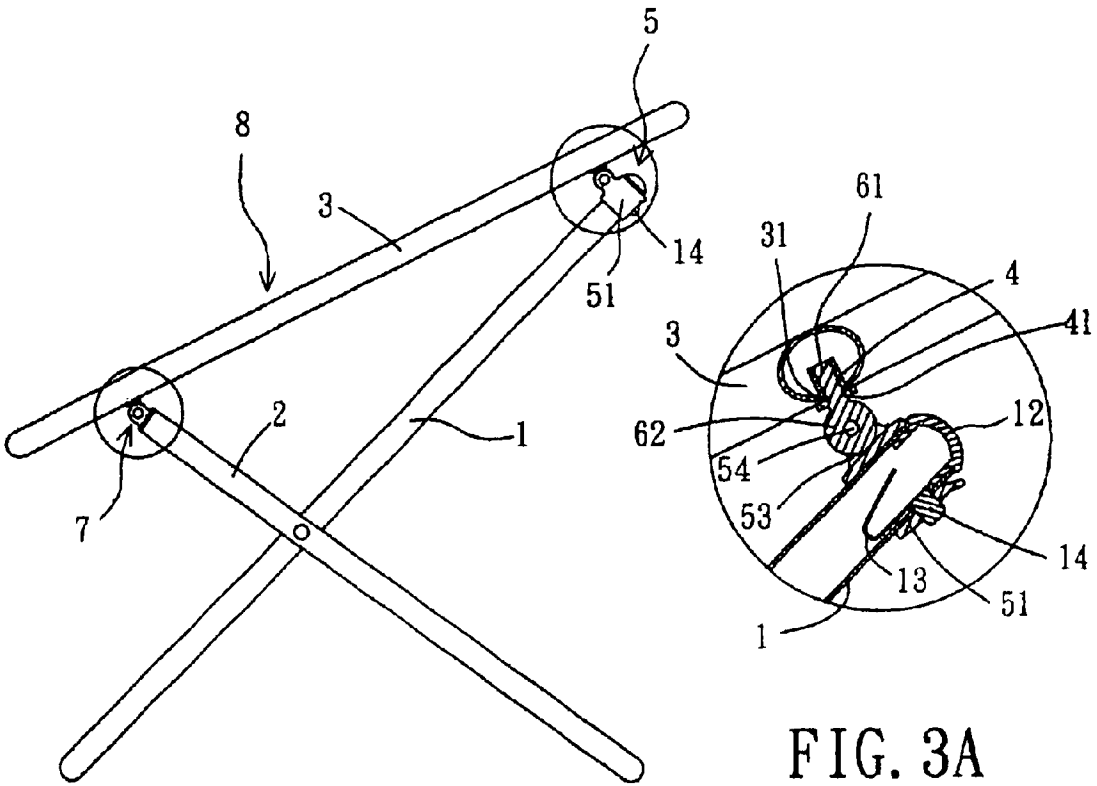
FIG. 3A
FIG. 3
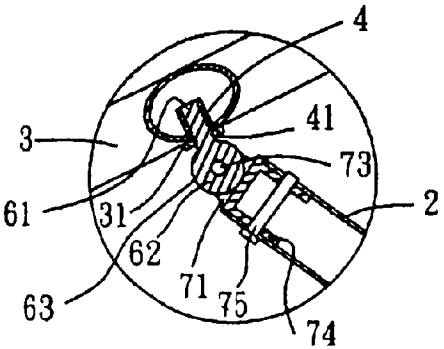
FIG. 3B

CHAIR ASSEMBLY

BACKGROUND OF THE INVENTION

1. Field of the Invention

The present invention relates to a chair assembly, and more particularly to a chair assembly that can be folded and expanded easily and conveniently.

2. Description of the Related Art

A conventional fixed chair forms a rigid and stable support to the user, so that the user can be seated on the chair comfortably. However, the conventional fixed chair has a fixed volume and cannot be folded, thereby causing inconvenience to the user where carrying storing the chair. In addition, the conventional fixed chair has a fixed size and cannot be folded, thereby occupying larger space when not in use. A conventional foldable chair can be expanded when in use and can be folded when not in use so as to save the space, thereby facilitating the user carrying and storing the conventional foldable chair. However, the conventional foldable chair tends to be folded unintentionally, thereby causing danger to the user.

SUMMARY OF THE INVENTION

The primary objective of the present invention is to provide a chair assembly that can be folded and expanded easily and conveniently.

Another objective of the present invention it to provide a chair assembly that can be supported rigidly and stably.

In accordance with the present invention, there is provided a chair assembly, comprising a first support stand, a second support stand, a support frame, four support tubes, four connecting members, two first mounting members, two elastic members, and two second mounting members, wherein:

the first support stand has two opposite sides each having a distal end formed with a through hole;

the second support stand has two opposite sides pivotally connected with the two opposite sides of the first support stand;

the support frame is mounted on the first support stand and the second support stand and has a periphery formed with four insertion holes;

each of the four support tubes is secured in a respective one of the four insertion holes of the support frame and has an inner wall formed with a screw bore;

each of the four connecting members is secured on a respective one of the four support tubes and has a first end formed with a threaded rod screwed into the screw bore of a respective one of the four support tubes and a second end formed with a pivot portion formed with a pivot hole;

each of the two first mounting members is movably mounted on the distal end of a respective one of the two opposite sides of the first support stand and is pivotally connected with a respective one of the four connecting members;

each of the two first mounting members has a wall formed with a positioning hole aligning with the through hole of the first support stand;

each of the two elastic members is mounted in the distal end of a respective one of the two opposite sides of the first support stand and has an end formed with a positioning snap extended through the through hole of the first support stand and protruded outward from the positioning hole of a respective one of the two first mounting members, so that each of the two first mounting members is secured on the distal end of a respective one of the two opposite sides of the first support stand by the positioning snap of the elastic member; and each of the two second mounting members is secured on the distal end of a respective one of the two opposite sides of the second support stand and is pivotally connected with a respective one of the four connecting members.

Further benefits and advantages of the present invention will become apparent after a careful reading of the detailed description with appropriate reference to the accompanying drawings.

BRIEF DESCRIPTION OF THE DRAWINGS

FIG. 3 is a plan view of the chair assembly in accordance with the preferred embodiment of the present invention;

FIG. 3A is a partially enlarged cross-sectional view of the chair assembly as shown in FIG. 3;

FIG. 3B is a partially enlarged cross-sectional view of the chair assembly as shown in FIG. 3;

DETAILED DESCRIPTION OF THE INVENTION

Figure 1:
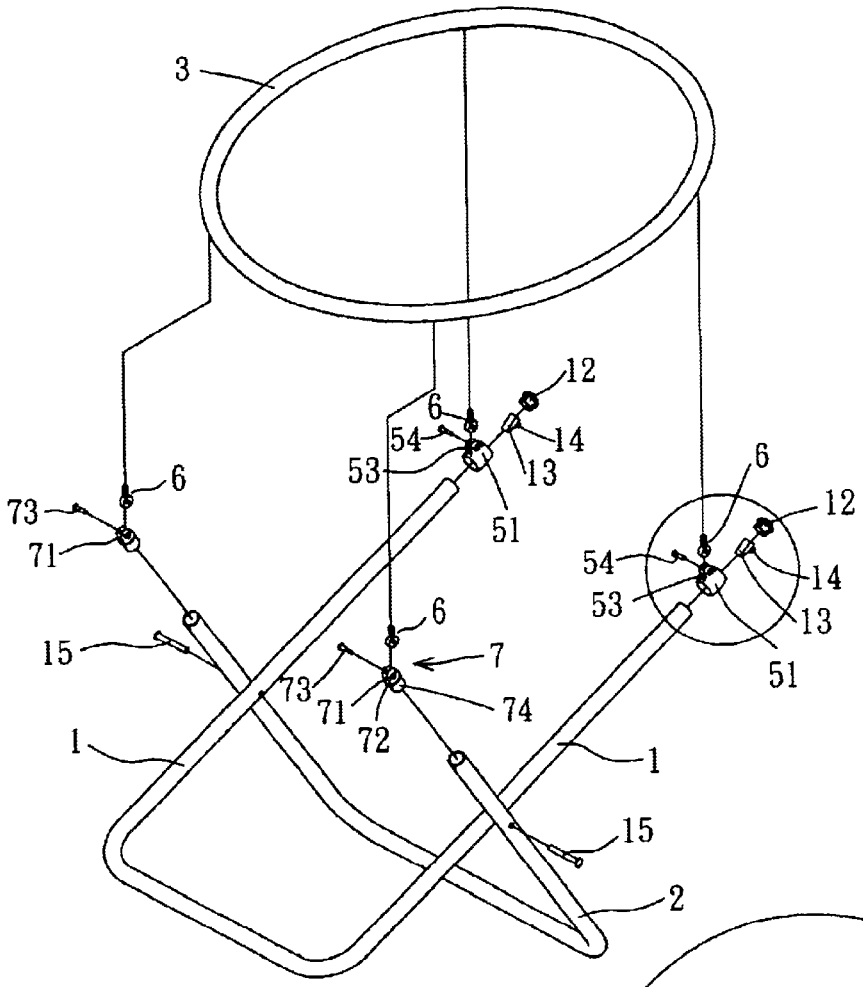
FIG. 1 is an exploded perspective view of a chair assembly in accordance with the preferred embodiment of the present invention.
Figure 2A:
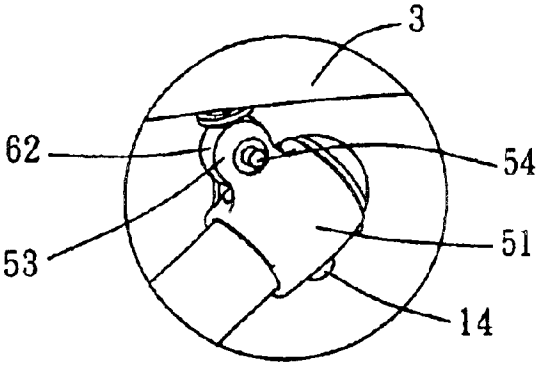
FIG. 2A is a partially enlarged view of the chair assembly as shown in FIG. 2.
Figure 2B:
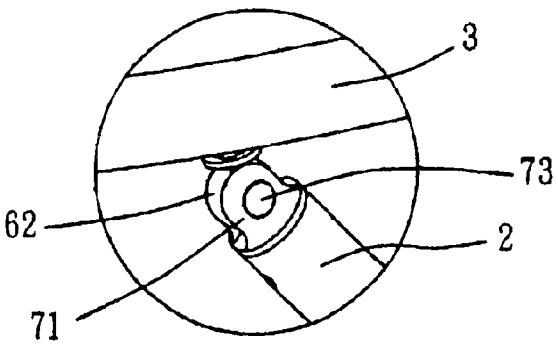
FIG. 2B is a partially enlarged view of the chair assembly as shown in FIG. 2.
Figure 2:
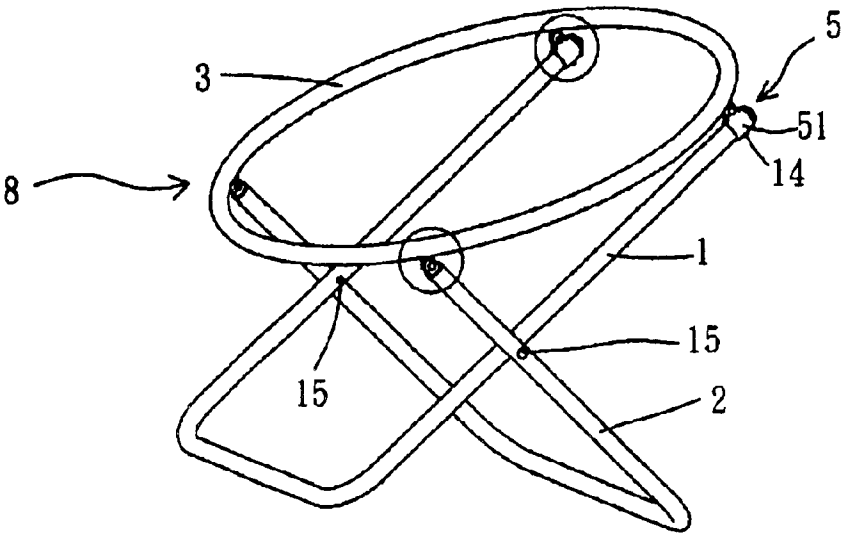
FIG. 2 is a perspective view of the chair assembly in accordance with the preferred embodiment of the present invention.

Referring to the drawings and initially to FIGS. 1–3, a chair assembly 8 in accordance with the preferred embodiment of the present invention comprises a first support stand 1, a second support stand 2, a support frame 3, four support tubes 4, four connecting members 6, two first mounting members 5, and two second mounting members 7.

Figure 1A:
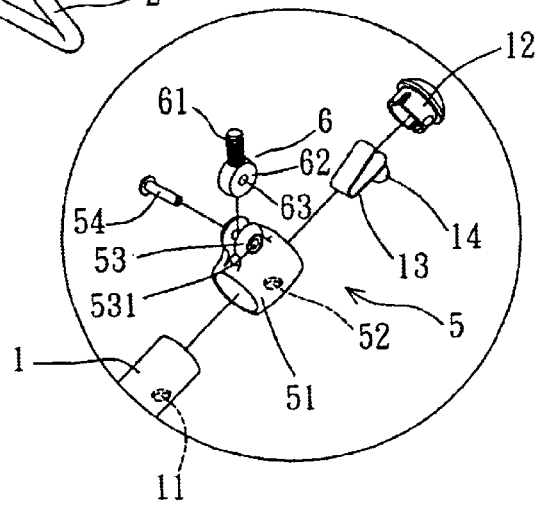
FIG. 1A is a partially enlarged view of the chair assembly as shown in FIG. 1.

The first support stand 1 is substantially U-shaped and has two opposite sides each having a distal end formed with a through hole 11 (see FIG. 1A).

The second support stand 2 is substantially U-shaped and has two opposite sides pivotally connected with the two opposite sides of the first support stand 1 by two pivot pins 15.

The support frame 3 is mounted on the first support stand 1 and the second support stand 2 and has a periphery formed with four insertion holes 31 (see FIG. 3A).

Each of the four support tubes 4 (see FIG. 3A) is secured in a respective one of the four insertion holes 31 of the support frame 3 and has an inner wall formed with a screw bore 41.

Each of the four connecting members 6 is secured on a respective one of the four support tubes 4 and has a first end formed with a threaded rod 61 screwed into the screw bore 41 of a respective one of the four support tubes 4 and a second end formed with a circular pivot portion 62 formed with a pivot hole 63.

Each of the two first mounting members 5 is movably mounted on the distal end of a respective one of the two opposite sides of the first support stand 1 and is pivotally connected with a respective one of the four connecting members 6.

As shown in FIGS. 1A and 2A, each of the two first mounting members 5 has a periphery formed with two spaced circular pivot ears 53 each formed with a pivot hole 531, and the chair assembly 8 further comprises two pivot pins 54 each extended through the pivot hole 531 of each of the two pivot ears 53 of a respective one of the two first mounting members 5 and the pivot hole 63 of the pivot portion 62 of a respective one of the four connecting members 6, so that the pivot portion 62 of the connecting member 6 is pivotally mounted between the two pivot ears 53 of the respective first mounting member 5.

Each of the two first mounting members 5 has a wall 51 formed with a positioning hole 52 aligning with the through hole 11 of the first support stand 1, and the chair assembly 8 further comprises two elastic members 13 each mounted in the distal end of a respective one of the two opposite sides of the first support stand 1 and each having an end formed with a positioning snap 14 extended through the through hole 11 of the first support stand 1 and protruded outward from the positioning hole 52 of a respective one of the two first mounting members 5 as shown in FIGS. 2A and 3A, so that each of the two first mounting members 5 is secured on the distal end of a respective one of the two opposite sides of the first support stand 1 by the positioning snap 14 of the elastic member 13. The chair assembly further comprises two end caps 12 each removably mounted on the distal end of a respective one of the two opposite sides of the first support stand 1 to enclose the respective elastic member 13.

Each of the two second mounting members 7 is secured on the distal end of a respective one of the two opposite sides of the second support stand 2 and is pivotally connected with a respective one of the four connecting members 6.

As shown in FIGS. 2B and 3B, each of the two second mounting members 7 has a first end formed with two spaced circular pivot ears 71 each formed with a pivot hole 72, and the chair assembly 8 further comprises two pivot pins 73 each extended through the pivot hole 72 of each of the two pivot ears 71 of a respective one of the two second mounting members 7 and the pivot hole 63 of the pivot portion 62 of a respective one of the four connecting members 6, so that the pivot portion 62 of the connecting member 6 is pivotally mounted between the two pivot ears 71 of the respective second mounting member 7.

In addition, each of the two second mounting members 7 has a second end formed with an insert 74 (see FIG. 3B) inserted into the distal end of a respective one of the two opposite sides of the second support stand 2, and the chair assembly 8 further comprises two fixing pins 75 (see FIG. 3B) each extended through the distal end of a respective one of the two opposite sides of the second support stand 2 and the insert 74 of a respective one of the two second mounting members 7, so that each of the two second mounting members 7 is secured on the distal end of a respective one of the two opposite sides of the second support stand 2.

In operation, referring to FIGS. 1–4, the positioning snap 14 of each of the two elastic members 13 is protruded outward from the positioning hole 52 of a respective one of the two first mounting members 5 as shown in FIGS. 2A and 3A, so that each of the two first mounting members 5 is secured on the first support stand 1, and the chair assembly 8 is disposed at an expanded state as shown in FIG. 3.

Figure 4B:
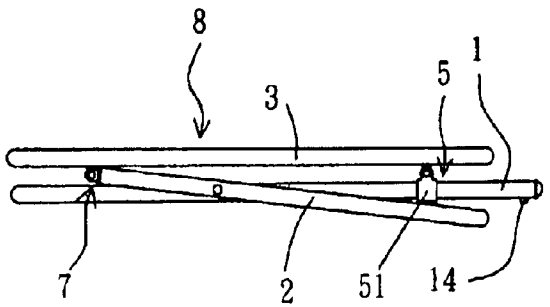
FIG. 4B is a schematic operational view of the chair assembly as shown in FIG. 4A.
Figure 4A:
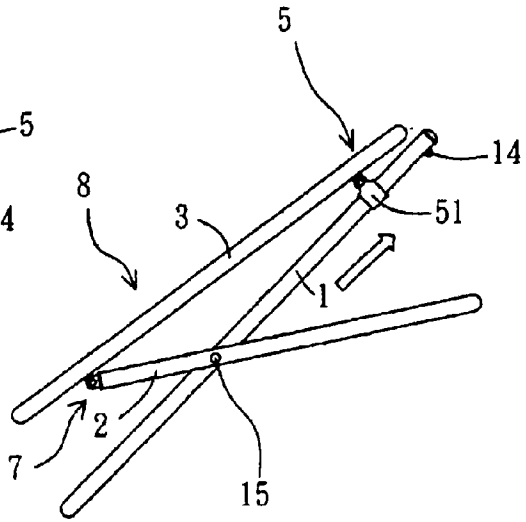
FIG. 4A is a schematic operational view of the chair assembly as shown in FIG. 4.
Figure 4:
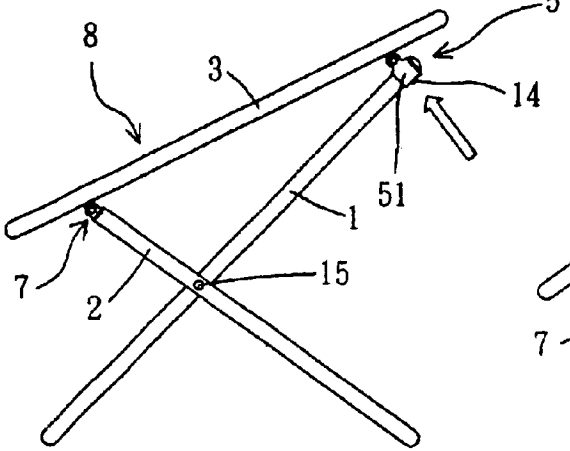
FIG. 4 is a schematic operational view of the chair assembly as shown in FIG. 3.

When the user wishes to fold the chair assembly 8, the positioning snap 14 of each of the two elastic members 13 is pressed inward as shown in FIG. 4 to detach from the positioning hole 52 of a respective one of the two first mounting members 5, so that each of the two first mounting members 5 is detached from the first support stand 1. Then, the support frame 3 is pressed downward, so that the first support stand 1 is pressed to move relative to the two first mounting members 5 as shown in FIG. 4A, and the second support stand 2 is pivoted with the first support stand 1, thereby folding the chair assembly 8 as shown in FIG. 4B.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A chair assembly, comprising a first support stand, a second support stand, a support frame, four support tubes, four connecting members, two first mounting members, two elastic members, and two second mounting members, wherein:

the first support stand has two opposite sides each having a distal end formed with a through hole;

the second support stand has two opposite sides pivotally connected with the two opposite sides of the first support stand;

to the support frame is mounted on the first support stand and the second support stand and has a periphery formed with four insertion holes;

each of the four support tubes is secured in a respective one of the four insertion holes of the support frame and has an inner wall formed with a screw bore;

each of the four connecting members is secured on a respective one of the four support tubes and has a first end formed with a threaded rod screwed into the screw bore of a respective one of the four support tubes and a second end formed with a pivot portion formed with a pivot hole;

each of the two first mounting members is movably mounted on the distal end of a respective one of the two opposite sides of the first support stand and is pivotally connected with a respective one of the four connecting members;

each of the two first mounting members has a wall formed with a positioning hole aligning with the through hole of the first support stand;

each of the two elastic members is mounted in the distal end of a respective one of the two opposite sides of the first support stand and has an end formed with a positioning snap extended through the through hole of the first support stand and protruded outward from the positioning hole of a respective one of the two first mounting members, so that each of the two first mounting members is secured on the distal end of a respective one of the two opposite sides of the first support stand by the positioning snap of the elastic member; and each of the two second mounting members is secured on the distal end of a respective one of the two opposite sides of the second support stand and is pivotally connected with a respective one of the four connecting members.

2. The chair assembly in accordance with claim 1, wherein the first support stand is substantially U-shaped.

3. The chair assembly in accordance with claim 1, wherein the second support stand is substantially U-shaped.

4. The chair assembly in accordance with claim 1, wherein the pivot portion of each of the four connecting members has a circular shape.

5. The chair assembly in accordance with claim 1, wherein each of the two first mounting members has a periphery formed with two spaced circular pivot ears each formed with a pivot hole, and the chair assembly further comprises two pivot pins each extended through the pivot hole of each of the two pivot ears of a respective one of the two first mounting members and the pivot hole of the pivot portion of a respective one of the four connecting members, so that the pivot portion of the connecting member is pivotally mounted between the two pivot ears of the respective first mounting member.

6. The chair assembly in accordance with claim 1, further comprising two end caps each removably mounted on the distal end of a respective one of the two opposite sides of the first support stand to enclose the respective elastic member.

7. The chair assembly in accordance with claim 1, wherein each of the two second mounting members has a first end formed with two spaced circular pivot ears each formed with a pivot hole, and the chair assembly further comprises two pivot pins each extended through the pivot hole of each of the two pivot ears of a respective one of the two second mounting members and the pivot hole of the pivot portion of a respective one of the four connecting members, so that the pivot portion of the connecting member is pivotally mounted between the two pivot ears of the respective second mounting member.

8. The chair assembly in accordance with claim 1, wherein each of the two second mounting members has a second end formed with an insert inserted into the distal end of a respective one of the two opposite sides of the second support stand, and the chair assembly further comprises two fixing pins each extended through the distal end of a respective one of the two opposite sides of the second support stand and the insert of a respective one of the two second mounting members, so that each of the two second mounting members is secured on the distal end of a respective one of the two opposite sides of the second support stand.

* * * * *